US005099890A

United States Patent [19]

Duetsch et al.

[11] Patent Number: 5,099,890

[45] Date of Patent: Mar. 31, 1992

[54] WARP TENSIONING APPARATUS FOR PRODUCING A SEERSUCKER FABRIC

[75] Inventors: Hans Duetsch; Hans Geiger, both of Lindau, Fed. Rep. of Germany

[73] Assignee: Lindauer Dornier GmbH, Lindau, Fed. Rep. of Germany

[21] Appl. No.: 661,051

[22] Filed: Feb. 25, 1991

[30] Foreign Application Priority Data

Feb. 23, 1990 [DE] Fed. Rep. of Germany ..... 4005751

[51] Int. Cl.[5] ..... D03D 27/06

[52] U.S. Cl. ..... 139/25; 139/102

[58] Field of Search ..... 139/21, 24, 25, 102

[56] References Cited

U.S. PATENT DOCUMENTS 3,900,051 8/1975 Bucher ..... 139/102 X 4,112,981 9/1978 Freisler ..... 139/25 X 4,721,134 1/1988 Dorman et al. ..... 139/25

*Primary Examiner*—Andrew M. Falik

*Attorney, Agent, or Firm*—W. G. Fasse

[57] ABSTRACT

A device for producing a seersucker fabric on a loom lengthens the effect or pile warp threads compared to the base warp threads at the binding point of the woven fabric. The device is arranged on the outlet side of the loom. Simultaneously, the effect or pile warp thread gang is relieved of tensile loads on the inlet side of the loom in such a manner that it will retreat or creep back to the pile warp beam as little as possible. A lengthening of 41% and more is achieved, compared to length additions in the prior art in the range of 30 to 32%. Additionally a very uniform seersucker fabric free of faults is produced.

7 Claims, 2 Drawing Sheets

WARP TENSIONING APPARATUS FOR PRODUCING A SEERSUCKER FABRIC

The invention relates to a device for producing a seersucker fabric on weaving machines, whereby an oscillating forward and backward motion is applied to the finished woven fabric made of base warp threads, effect or pile warp threads, and weft threads.

BACKGROUND OF THE INVENTION

Heretofore, the oscillating forward and backward motion is applied to the fabric at the binding or beat-up point in a rhythm 1:1 superimposed on the normal woven web withdrawal motion equivalent to that of a linen binding characteristic of the seersucker fabric. The motion application is such that the effect or pile warp threads undergo a length addition in comparison to the base warp threads. The device is connected to a drive branched off from the main drive train of the loom.

Conventional devices used heretofore achieve the necessary differential motion between the base warp thread gang and the effect and pile warp thread gang in such a manner that the length addition was obtained through the naturally occurring differing tensions (tension difference between the effect or pile warp thread gang and the base warp thread gang). Conventionally, these different tensions are achieved by a different drive of the pile warp beam compared to the base warp beam of the loom. In this manner, the intended length addition for the effect or pile warp threads can only be achieved more or less randomly. Thus, in this context it is only possible to adjust the length addition within a relatively large scatter range. Heretofore, during the beat-up of the weft thread the effect or pile warp threads adjusted for a somewhat easier movement, were carried along more than the base warp threads, whereby the desired length addition is achieved. However, this length addition is only reproducible within a large scatter range so that the woven fabric produced by such a known device is in itself very nonuniform, especially when a large length addition was called for. With these known devices, length additions up to approximately 30 to 32% can be achieved.

OBJECT OF THE INVENTION

It is the object of the invention to suggest a device with the above described characteristics by means of which woven fabric can be produced having noticeably larger length additions for the effect or pile warp threads and which moreover is characterized by a quite considerably larger uniformity of the woven fabric structure.

SUMMARY OF THE INVENTION

In order to achieve this object, the invention is characterized in that a first shaft extending across the width of the loom, is rotatably supported at its free ends by a bearing mounted in the respective loom housing wall on the output side of the loom downstream of the interlacing or beat-up point of the woven fabric. An eccentric cam disk is rigidly connected to the first shaft close to the respective bearings. Each eccentric cam disk is in operative contact with a cam follower roller of a roller lever rotatably arranged on a bearing plate. Each roller lever is connected by a connecting rod to a clamping holder which is oscillatingly mounted in the area of said bearing plate. Furthermore, the clamping holders hold the free ends of a second shaft extending across the loom width, wherein the clamping holders are mounted in a pivot bearing arranged eccentrically to the lengthwise axis of the second shaft. The first shaft of the device according to the invention is driven by a drive branched off from the main drive train of the loom. The second shaft is also driven by the same branched off drive so that both shafts oscillate in unison for adding a length of thread to each effect or pile warp thread as compared to the length of the base warp threads.

The object of the invention has been achieved by this measure. It is now possible with an absolutely precisely uniform processing of the woven fabric, to achieve a considerably greater length addition which is in the range of 41% or even greater. Thus, it is essential that the oscillating motion is imparted to the already finished woven fabric, whereby it is simultaneously assured that the effect or pile warp thread gang on the supply or infeed side of the loom proper does not creep back to the pile warp beam during this oscillating motion. This is achieved by an especially easy movement guidance of the effect or pile warp threads on the infeed side.

The oscillating motion can be achieved in several different ways. For example, it is also possible to provide for this purpose two rollers which are slideable relative to each other and which are respectively adjustable toward the woven fabric, whereby the rollers then take up the woven fabric between themselves in the manner of a shearing effect. These rollers are tiltably arranged in a right angle to the plane of the woven fabric so that thereby also a forward and reverse motion of the woven fabric is achieved.

Although it is known in the prior art to oscillatingly drive a pivot arm on the upper structural console, these means alone do not achieve the required uniformity of the woven fabric because the uniform processing of the woven fabric cannot be achieved, due to the frictional losses in the shed of the loom, and due to the length and the great stretching of the yarn which takes place up to the binding or interlacing point of the woven fabric. Thus, in this context, the invention follows a totally new path in that it is suggested for the first time to carry out the oscillation motion only on the outlet or withdrawal side of the loom and thus the oscillation is applied only to the finished woven fabric, in other words, behind and as close as possible to the binding point of the woven fabric.

In order to relieve tension from the effect or pile warp thread gang on the feed-in or warp supply side of the loom it is preferable that the swingable arm with the idler shaft arranged behind the pile warp beam, is embodied to have a mass as low as possible. One will construct the idler shaft as a hollow shaft and manufacture the swingable arm, together with its idler shaft, out of light metal or lightweight material.

Moreover, it is important for this purpose that the pile warp beam is driven by a motor controllable as exactly as possible in its r.p.m. and in its torque moment.

In this context it is also important that the tilt angle of the swingable arm is adjustable and the respectively achieved adjustment can be exactly monitored.

BRIEF DESCRIPTION OF THE DRAWINGS

The invention will be described in more detail in the following in conjunction with an example embodiment from which further important characteristics arise.

Figure 1:
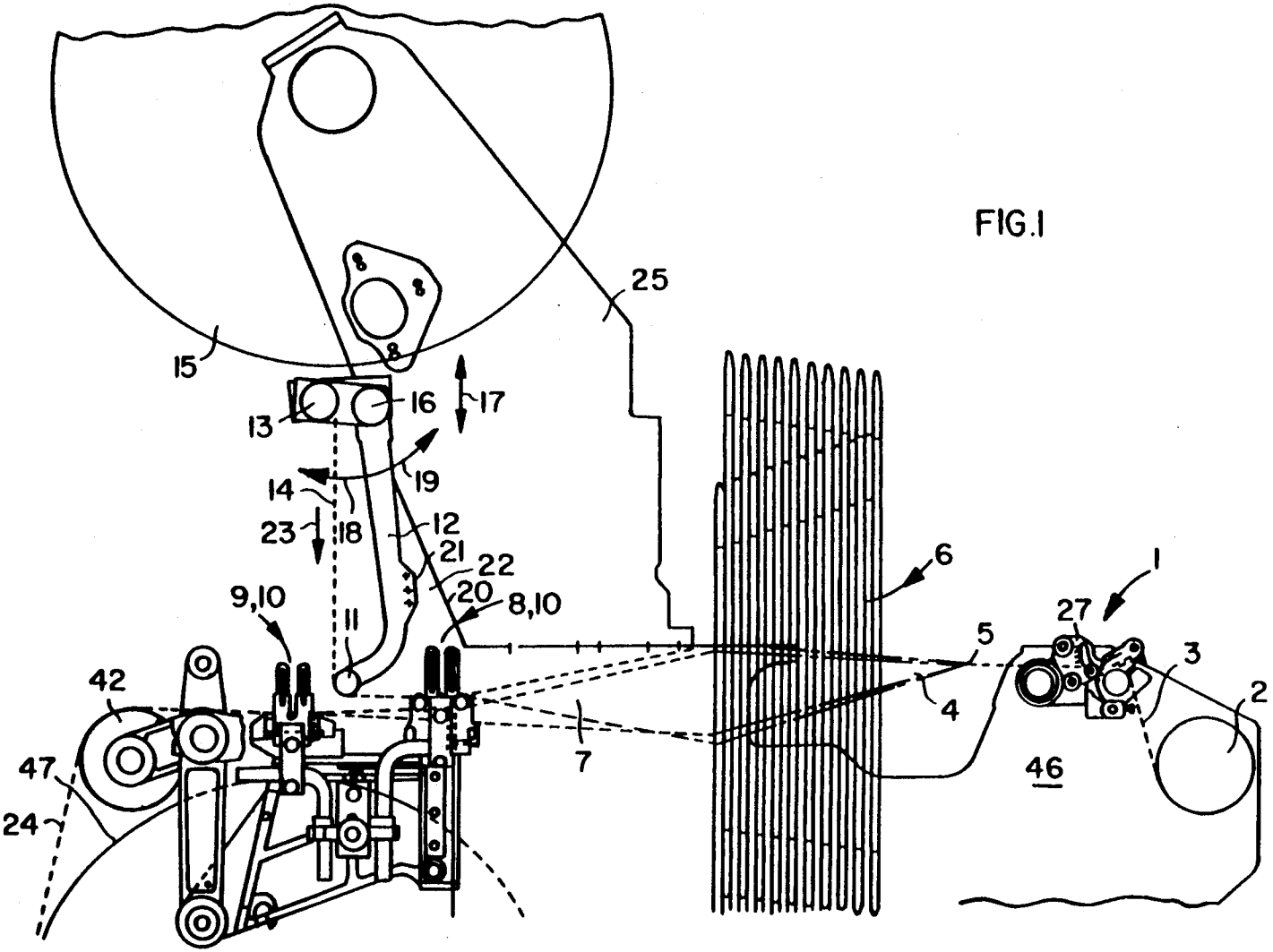
FIG. 1 shows a side view of a loom embodied according to the invention with a device arranged on the withdrawal side, for applying the required oscillating motion to the woven fabric.

DETAILED DESCRIPTION OF THE PREFERRED EXAMPLE EMBODIMENTS AND THE BEST MODE OF THE INVENTION

A conventional loom is provided which is still to be modified on the warp feed-in side as will be explained in still greater detail below. The device 1 according to the invention is provided on the fabric withdrawal side and is arranged near the take-up roller 2 of the loom over which the woven fabric 3 runs (compare FIG. 1).

Effect or pile warp threads 14 run from the outlet of the pile warp beam 15 into a loom shed 4, whereby a binding or interlacing point 5 is conventionally defined.

Shafts 6 are provided. Thus, in the area of the shafts 6 the shed 4 is arranged as a front shed while behind the shafts the rear shed 7 is arranged.

Two groups 8 and 9 of warp thread monitors 10 are provided which monitor the thread insertion, whereby the group 8 of the thread monitors 10 is used for monitoring the effect or pile warp threads 14 and group 9 of the thread monitors 10 is used to monitor the base warp threads 24.

Furthermore, an easily movable, lightweight, easily tiltable sensor shaft 11 is provided on an upper structural console 25 of the loom, whereby the sensor shaft 11 is supported on an arm 12.

Additionally, an idler or guide shaft 13 is rigidly arranged on the upper structural console 25 and serves for guiding around the effect or pile warp threads 14 which are being pulled off of the pile warp beam 15.

The swingable arm 12 is tiltably supported, whereby its tilting or journal point 16 is constructed to be adjustable in the directions of the arrow 17, whereby, it is possible to influence the elevation of the rear shed 7.

The feeler or sensor shaft 11 has the purpose of simultaneously functioning as a calender roller and as a compensating roller. In this context it is essential that the effect or pile warp thread gang 14 is not separated by the arm 12 itself because the gang is guided around the feeler or sensor shaft 11 on the other end of the arm 12.

Now it is important that the effect or pile warp thread gang 14 is fed into the loom shed 7 with the smallest possible rubbing frictional resistance and under the lowest possible tension in order to achieve a length addition which is as uniform as possible. Here this length addition refers to the length of the effect or pile warp threads 14 compared to the length of the base warp threads 24.

In this context it is essential that the pile warp beam 15 is driven through a drive, which is not shown in detail, by means of a motor which may be exactly controlled in its r.p.m. and in its torque moment in order to ensure a pulling out of the effect or pile warp threads 14 with as little tension as possible. The swingable arm 12 is biased by a spring arrangement in the arrow direction 18. The spring arrangement is not shown in detail, but provides a certain biasing in the arrow direction 18 in order to slightly bias the effect or pile warp thread gang 14.

The feeler or sensor shaft 11 thus tilts in the direction of the shown arrow directions 18, 19, about the journal point 16.

The swingable arm 12 serves as a feeler or sensor arm. Stated differently, a proximity or limit switch is arranged approximately at position 20 and a corresponding operating element 21 is cooperatively arranged thereto on the feeler arm 12.

The spacing 22 between these two elements is exactly monitored by an electronic control circuit. This spacing is used as the control value for controlling the r.p.m. of the drive of the pile warp beam 15, whereby it is assured that the effect or pile warp thread gang 14 is constantly drawn off of the pile warp beam 15 with a uniform tension.

It is important that the swingable arm 12 is constructed to have a mass as low as possible in order to allow a quick reaction. In order to achieve a low inertial swingable arm 12, the feeler shaft 11 is made of a thin-walled hollow material and the swingable arm 12 is dimensioned as small as possible and is produced from a light metal material, for example aluminum or the like.

The rotational bearing at the pivot or journal 16 is constructed to be as free running as possible, for example, as a ballbearing.

It is also important that a total of four such arms 12 are arranged in parallel but with a relative spacing from one another for controlling the effect or pile warp thread gang 14, and that the feeler arrangement relative to the position 20, 21, 22 is only arranged on one single arm 12. This is all that is required, because the tension of the thread gang 14 only needs to be determined at one swingable arm 12.

The swingable arms 12 are supported on a common shaft, stated differently, on a common journal point 16 which is, as mentioned above, vertically adjustable in the arrow direction 17.

Thus, starting from the pile warp beam 15 the effect or pile warp thread gang 14 is reeled off in the arrow direction 23.

In the device 1 according to the invention the woven fabric 3 is caused to oscillate downstream of the binding point 5, in order to achieve the desired large length addition to the effect or pile warp threads compared to the base warp threads.

Figure 2:
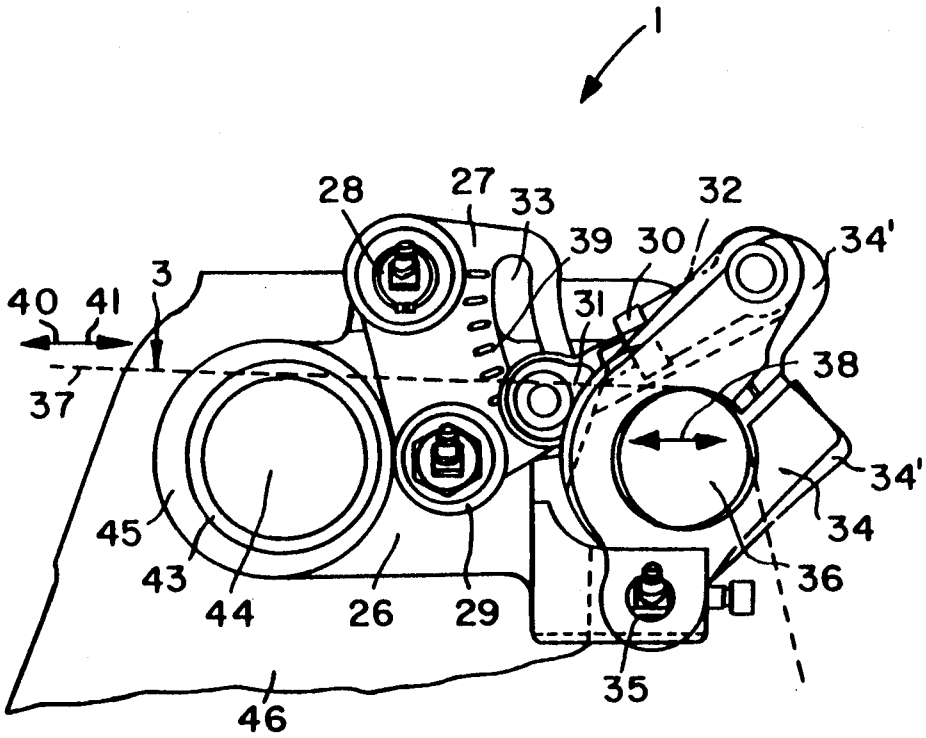
FIG. 2 shows the device with which the oscillating motion is applied to the woven fabric on an enlarged scale relative to FIG. 1.

In FIG. 2, this device is shown in two different tilted positions.

In detail, the device comprises a shaft 44 on which two eccentric cam disks 45 are rotationally ridigly arranged at a spacing from each other. The shaft is supported at the vertical side walls of the loom housing 46. This shaft, together with the shaft 36, extend exactly across the total loom width. In the view of FIG. 2, only the one right eccentric cam disk 45 is shown, while an identical similar type eccentric cam disk is arranged on the opposite side of the loom 46.

A roller lever 27 is swingably or tiltably supported in a swing or journal bearing 28 on the bearing plate 26, whereby a roller 29 runs along the eccentric cam disk 45.

In this context, the roller 29 is pressed by a coupling rod 30 against the eccentric cam disk 45, whereby the coupling rod 30 individually comprises two articulated or pivot tie rod heads 31 and 32. The pivot tie rod head 31 reaches into an elongated curved hole 33 where it is slideable in a stepless manner.

The other articulated tie rod head 32 is journalled to a clamping holder 34 which is tiltably supported in a journal bearing 35 on the bearing plate 26. The clamping holder 34 clamps in a shaft 36, whereby the clamping holder is shown in two different positions. One tilting position is referenced as position 34'.

The function of the device is as follows. The woven fabric 3 enters into the device 1 as a dashed line 37 (FIG. 2) and is redirected downwardly over the shaft 36.

The shaft 36 is driven to oscillate in the arrow directions 38 about the journal bearing 35. The drive is achieved by the eccentric cam disk 45 which contacts the roller 29 in a force transmitting manner, whereby the roller 29 is tilted out about the journal bearing 28 and whereby the clamping holder 34 is tiltably driven in the arrow directions 38 about the bearing 35 by means of the steplessly adjustable coupling rod 30. Thus, there results an oscillating motion of which the frequency and r.p.m. depends on the eccentric cam disk 45. One revolution of the eccentric cam disk 45 results for each shot, so that an oscillating motion occurs per shot.

FIG. 2 further shows how the articulated head 31 can be adjusted in the area of the arresting notches 39 in the elongated cured hole 33 and is then rigidly locked.

Thus, it is possible to reproducibly reselect adjustments or settings which were previously used, but then later changed. Therefore, a gage or standard is provided for achieving a reproducible setting or adjustment of the effect or pile warp thread processing.

Accordingly, the device according to the invention as shown in FIGS. 1 and 2 imparts an oscillating motion in the arrow directions 40, 41 to the entire woven fabric 3. This feature assures that the effect or pile warp thread gang 14 and the base warp thread gang 24 are carried along forwardly in the arrow direction 41, while during the return stroke in the arrow direction 40 the easily movable swingable arm 12 makes sure that the effect or pile warp thread gang 14 is delayed, while the base warp thread gang 24 which is under a higher tension due to its spring biasing, is relieved to thereby retreat backwardly. The spring loading is achieved herein in a manner known as such, by means of the base calender beam 42 which is spring biased and which thereby tensions the base warp thread gang in the arrow direction 40.

Thus, during the reverse motion of the woven web of the device 1 in the arrow direction 40, the base warp thread gang 24 moves rearwardly also in the arrow direction 40, and travels a greater distance while the pile warp thread gang 14 does not move in the arrow direction 40, but instead is delayed.

Thus, a difference is achieved between the motion of the base warp thread gang 24 and the effect or pile warp thread gang 14, which makes sure that during the reed beat-up against the binding point 5, the effect or pile warp threads are set up while forming a wave form or loop shape, so that the desired great length addition of more than 33%, up to more than 41%, compared to the length of the base warp, becomes effective. The magnitude of the desired length addition can be adjusted at the coupling rod 30, whereby it is possible to adjust or set a length addition within relatively broad boundaries because this is only dependent upon adjustment of this device 1. Tests by the Applicant have determined that a length addition of more than 41% is easily achievable. The maximum upper limit is determined by the woven fabric characteristics.

Although the invention has been described with reference to specific example embodiments, it will be appreciated that it is intended to cover all modifications and equivalents within the scope of the appended claims.

We claim:

1. A device for producing a seersucker fabric on a loom, wherein an oscillating forward and backward motion is applied to the finished woven fabric made of base warp threads, effect or pile warp threads, and weft threads, said device comprising a loom frame, first shame means (44) for handling said fabric extending across the width of said loom, bearing means (43) mounted in said loom frame for rotatably supporting said first shaft means (44) at its free ends on a fabric output side of said loom downstream of an interlacing or beat-up point of the woven fabric, eccentric cam disk means (45) rigidly connected to said first shaft means (44) close to the respective bearing means (43), cam follower means (29) arranged for cooperation with said cam disk means (45), cam follower lever means (27) rotatably mounted on a bearing plate (26) for carrying said cam follower means (29), clamping holder means (34) mounted for oscillation in an area of said bearing plate (26), coupling means (30) for connecting said cam follower lever means (27) to said clamping holder means (34), second shaft means (36) for handling said fabric extending across the width of said loom, said clamping holder means (34) holding free ends of said second shaft means, and journal bearing means (35) for mounting said clamping holder means (34) eccentrically to the lengthwise axis of said second shaft means for permitting an oscillation of said first and second shaft means in unison for adding a length of thread to each effect or pile warp thread as compared to the length of said base warp threads.

2. The device of claim 1, further comprising shaft drive means operatively connecting said first shaft means (44) to a main loom drive for imparting an oscillating motion to said first and second shaft means.

3. The device of claim 2, wherein said eccentric cam disk means (45) of said first shaft means (44) impart to said second shaft means (36) one back and forth movement for each weft thread insertion of said loom.

4. The device of claim 1, wherein said cam follower lever means (27) comprises an elongated curved hole (33), said coupling means (30) comprising a tie rod head reaching into said elongated curved hole (33) for connecting said coupling means (30) with said cam follower lever means (27).

5. The device of claim 4, wherein said coupling means (30) is adjustable in a step-free manner by means of said tie rod head (31) reaching into said elongated curved hole (33) in a lockable manner in any position along said elongated hole.

6. The device of claim 4, wherein said coupling means (30) is adjustable in a stepped manner by means of said toggle joint head reaching into said elongated hole at marked positions (39).

7. The device of claim 6, wherein said marked positions comprise arresting notches and scale markers (39) arranged laterally along the length of said elongated hole (33).

* * * * *

UNITED STATES PATENT AND TRADEMARK OFFICE

CERTIFICATE OF CORRECTION

PATENT NO. : 5,099,890

DATED : March 31, 1992

INVENTOR(S) : Hans Duetsch et al.

It is certified that error appears in the above-identified patent and that said Letters Patent is hereby corrected as shown below:

Claim 1, column 6, line 14, replace "shame" by --shaft--.

Signed and Sealed this

First Day of June, 1993

Michael K. Kirk

*Attest:*

MICHAEL K. KIRK

*Attesting Officer*

*Acting Commissioner of Patents and Trademarks*